US011273962B2

(12) United States Patent
Elliott

(10) Patent No.: US 11,273,962 B2
(45) Date of Patent: Mar. 15, 2022

(54) TAMPER-EVIDENT CLOSURE

(71) Applicant: Closure Systems International Inc., Indianapolis, IN (US)

(72) Inventor: Daniel Elliott, Brownsburg, IN (US)

(73) Assignee: Closure Systems International Inc., Indianapolis, IN (US)

( * ) Notice: Subject to any disclaimer, the term of this patent is extended or adjusted under 35 U.S.C. 154(b) by 1498 days.

(21) Appl. No.: 15/118,753

(22) PCT Filed: Feb. 17, 2015

(86) PCT No.: PCT/US2015/016136
§ 371 (c)(1),
(2) Date: Aug. 12, 2016

(87) PCT Pub. No.: WO2015/123666
PCT Pub. Date: Aug. 20, 2015

(65) Prior Publication Data
US 2017/0043921 A1 Feb. 16, 2017

Related U.S. Application Data

(60) Provisional application No. 61/939,852, filed on Feb. 14, 2014.

(51) Int. Cl.
*B65D 55/08* (2006.01)
*B65D 51/18* (2006.01)
(Continued)

(52) U.S. Cl.
CPC ..... *B65D 55/0863* (2013.01); *B65D 39/08* (2013.01); *B65D 41/3414* (2013.01);
(Continued)

(58) Field of Classification Search
CPC .... B65D 55/0863; B65D 39/08; B65D 51/18; B65D 2251/0028; B65D 2251/0078; B65D 41/3414; B65D 41/3423
See application file for complete search history.

(56) References Cited

U.S. PATENT DOCUMENTS 2,124,873 A 7/1938 Conner
3,901,403 A 8/1975 Menke
(Continued)

FOREIGN PATENT DOCUMENTS

DE 297 06 672 U1 6/1997
DE 197 08 909 A1 9/1998
(Continued)

OTHER PUBLICATIONS

European Search Report for European Patent Application No. 17159173.3 dated Jul. 5, 2017 (8 pages).
(Continued)

*Primary Examiner* — Anthony D Stashick
*Assistant Examiner* — L Kmet
(74) *Attorney, Agent, or Firm* — Nixon Peabody LLP

(57) ABSTRACT

Embodiments of a tamper-evident closure are disclosed which prevent unauthorized access to a container and its contents, deterring adulteration or introduction of counterfeit product. In one embodiment the tamper-evident closure can be fitted to an associated container and closure, and includes a portion which is removed by fracture of the tamper-evident closure to gain access to the container closure. In another embodiment, an arrangement of wedge-like tongues permit fitment of the tamper-evident closure to associated container for temper-evidence. In another embodiment, the tamper-evident closure is joined by frangible bridges to the container closure to provide the desired tamper-evidence. In another embodiment, the tamper-evi-
(Continued)

dent closure is movable axially of the associated container closure to thereby provide evidence of removal.

12 Claims, 10 Drawing Sheets

(51) Int. Cl.
*B65D 41/34* (2006.01)
*B65D 39/08* (2006.01)

(52) U.S. Cl.
CPC ..... *B65D 41/3423* (2013.01); *B65D 51/18* (2013.01); *B65D 2251/0015* (2013.01); *B65D 2251/0028* (2013.01); *B65D 2251/0078* (2013.01); *B65D 2251/0087* (2013.01); *B65D 2401/15* (2020.05); *B65D 2401/20* (2020.05); *B65D 2401/30* (2020.05); *B65D 2401/50* (2020.05)

(56) References Cited

U.S. PATENT DOCUMENTS 4,166,552 A 9/1979 Faulstitch
4,305,516 A 12/1981 Perne et al.
4,326,639 A 4/1982 Stahl et al.
4,346,811 A 8/1982 Hilaire
4,394,918 A 7/1983 Grussen
4,402,418 A 9/1983 Ostrowsky
4,458,821 A 7/1984 Ostrowsky
4,470,513 A 9/1984 Ostrowsky
4,478,343 A 10/1984 Ostrowsky
4,485,934 A 12/1984 Maguire
4,534,479 A 8/1985 Conti
4,540,100 A 9/1985 Willis
4,550,844 A 11/1985 Lininger
4,562,931 A 1/1986 Brach et al.
4,593,830 A 6/1986 Bullock
4,595,110 A 6/1986 Herr
4,613,052 A 9/1986 Gregory et al.
4,643,321 A 2/1987 Gach
4,657,153 A 4/1987 Hayes
4,664,278 A 5/1987 Barriac
4,667,838 A 5/1987 Yeager
4,667,839 A 5/1987 Crisci
4,801,030 A 1/1989 Barriac
4,807,770 A 2/1989 Barriac
4,856,665 A 8/1989 Dutt et al.
4,938,370 A 7/1990 McBride
4,981,230 A 1/1991 Marshall et al.
5,052,574 A 10/1991 McKinnon
5,076,453 A 12/1991 Odet
5,207,783 A 5/1993 Burton
5,456,375 A 10/1995 May
5,465,876 A 11/1995 Crisci
5,547,092 A 8/1996 Thompson
5,564,582 A 10/1996 Kamath
5,573,128 A 11/1996 Tsujiguchi et al.
5,678,714 A 10/1997 Guglielmini
5,711,443 A 1/1998 Bennett
5,715,959 A 2/1998 Pfefferkorn et al.
5,720,402 A 2/1998 May
5,725,115 A 3/1998 Bosl et al.
5,749,484 A 5/1998 Trout
5,769,263 A 6/1998 Willingham et al.
5,806,707 A 9/1998 Boehm et al.
5,813,563 A 9/1998 Boehm et al.
5,862,953 A 1/1999 Long, Jr.
5,891,380 A 4/1999 Larue et al.
5,913,436 A 6/1999 Breuer
5,915,579 A 6/1999 Przytulla
6,029,834 A 2/2000 Sanner
6,039,196 A 3/2000 Ekkert et al.
6,050,436 A 4/2000 Bennett et al.
6,213,321 B1 4/2001 Zumbuhl
6,253,939 B1 7/2001 Wan et al.
6,325,226 B1 12/2001 Krautkramer
6,332,550 B1 12/2001 Bennett et al.
6,557,714 B2 5/2003 Babcock et al.
6,758,359 B2 7/2004 Yurkewicz
6,769,575 B1 8/2004 Long, Jr.
6,779,672 B2 8/2004 Kano et al.
7,014,055 B2 3/2006 Kano et al.
7,243,807 B2 7/2007 Lin
7,264,131 B2 9/2007 Tsutsumi et al.
D578,889 S 10/2008 Sadiq
7,445,130 B2 11/2008 Bosl et al.
7,451,898 B2 11/2008 Seidita
7,503,468 B2 3/2009 Druitt et al.
7,537,159 B2 5/2009 Brozell
7,575,121 B2 8/2009 Ooka et al.
7,581,652 B2 9/2009 Flak et al.
7,607,547 B2 10/2009 Kumata et al.
7,637,384 B2 12/2009 Price et al.
7,645,414 B2 1/2010 Gregory et al.
7,651,004 B2 1/2010 Fuchs
7,703,642 B2 4/2010 Scott
7,802,690 B2 9/2010 Lohrman et al.
7,857,154 B2 12/2010 Pedlar
7,867,425 B2 1/2011 Major
7,905,820 B2 3/2011 Druitt
8,066,133 B2 11/2011 Takamatsu et al.
8,365,934 B2 2/2013 Hamana et al.
8,393,483 B2 3/2013 Druitt
8,763,830 B2 7/2014 Sadiq et al.
8,807,360 B2 8/2014 Erspamer et al.
2001/0027957 A1 10/2001 Kano
2002/0166873 A1* 11/2002 Staniszewski ..... B65D 55/0863 222/153.07
2004/0020943 A1 2/2004 Shinozaki
2004/0060893 A1 4/2004 Kano et al.
2004/0155006 A1 8/2004 Seidita
2004/0238478 A1 12/2004 Druitt et al.
2005/0077264 A1 4/2005 Fuchs
2005/0173367 A1 8/2005 Nusbaum et al.
2005/0211659 A1 9/2005 Tsutsumi et al.
2005/0252878 A1 11/2005 Babcock
2006/0032831 A1 2/2006 Major
2006/0138071 A1 6/2006 Tsutsumi et al.
2006/0138073 A1 6/2006 Ooka et al.
2006/0151418 A1 7/2006 Scott
2006/0255002 A1 11/2006 Takamatsu et al.
2006/0255003 A1 11/2006 Fuchs
2007/0023380 A1 2/2007 Shingle et al.
2007/0034590 A1 2/2007 Hidding
2007/0090080 A1 4/2007 Lohrman et al.
2007/0181525 A1 8/2007 Gregory et al.
2008/0067142 A1 3/2008 Druitt
2008/0087625 A1 4/2008 Kumata et al.
2008/0093363 A1 4/2008 Pedlar
2008/0314000 A1 12/2008 Druitt
2009/0045158 A1 2/2009 Suriol
2009/0159555 A1 6/2009 Druitt et al.
2009/0261057 A1 10/2009 Druitt et al.
2010/0038337 A1 2/2010 Garboni
2010/0276387 A1 11/2010 Hamana et al.

FOREIGN PATENT DOCUMENTS

FR 2278643 A1 11/1999
FR 2778643 A1 * 11/1999 ..... B65D 55/0863
JP 19760177786 U 8/1978
WO WO-2008031178 A1 * 3/2008 ..... B65D 47/043
WO WO 2009/154666 A2 12/2009
WO WO 2013/132384 9/2013
WO WO 2015/123666 A1 8/2015

OTHER PUBLICATIONS

International Search Report for International Application No. PCT/US2015/016136, dated May 20, 2015 (2 pages).

(56) References Cited

OTHER PUBLICATIONS

Extended European Search Report for European Patent Application No. 15748589.7 dated Sep. 28, 2017 (7 pages).

* cited by examiner

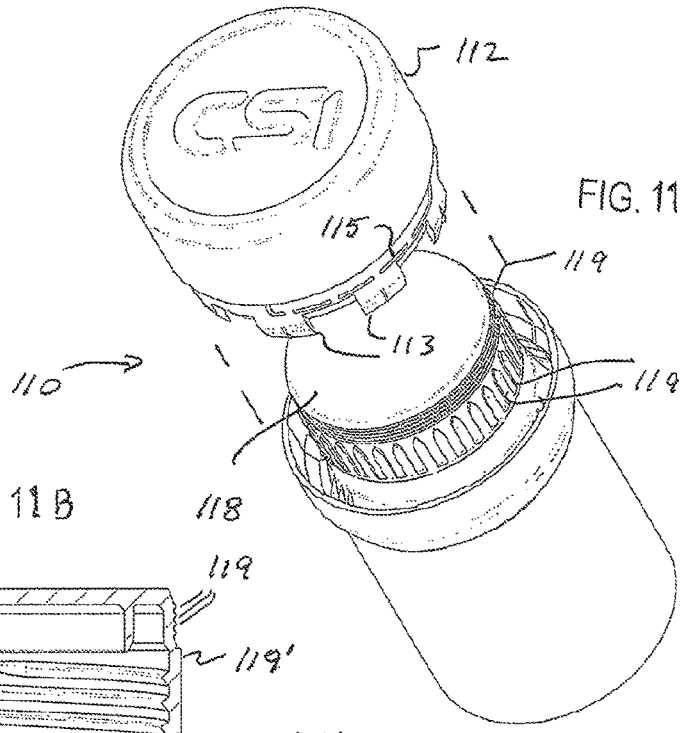
FIG. 11A
FIG. 11B
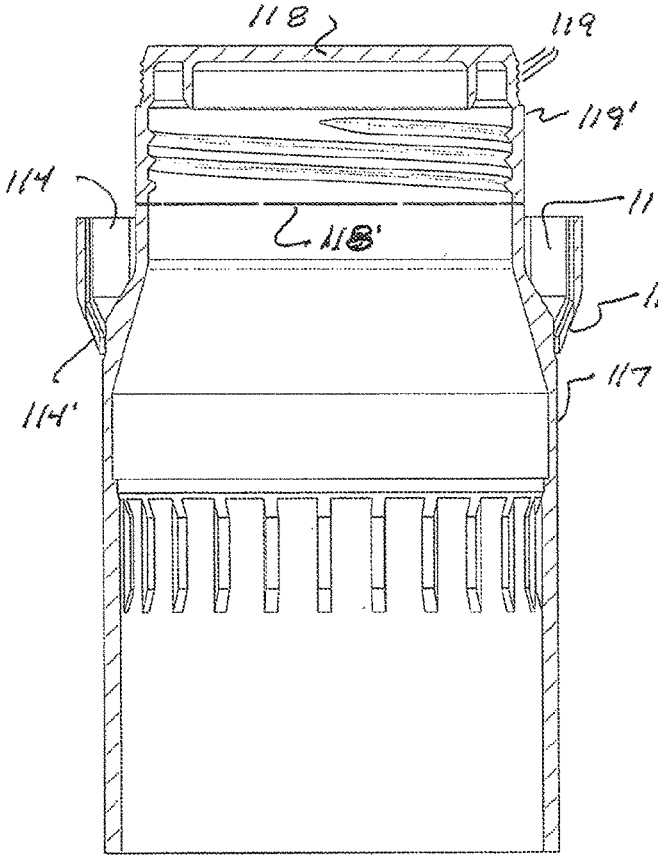
FIG. 11C
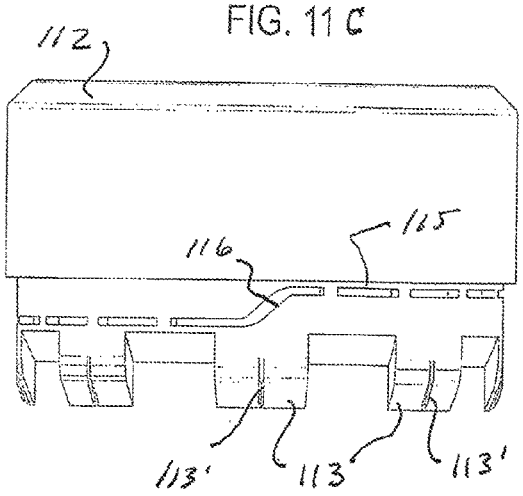

TAMPER-EVIDENT CLOSURE

FIELD OF THE INVENTION

The present invention relates generally to polymeric beverage closures. In particular, the present invention relates to polymeric beverage closures having tamper-evident features, and which are reusable for opening and reclosing a beverage container following removal or actuation of the tamper-evident feature(s). Embodiments of the invention may include a security closure arrangement, having tamper-evident features which inhibit the ability of an unauthorized agent from adulterating the package contents or providing counterfeit goods unbeknownst to the end consumer.

BACKGROUND OF THE INVENTION

Reclosable tamper-evident or tamper-resistant closures are increasingly popular, especially in the spirits market. Many studies have shown that spirits and other alcoholic beverages are particularly susceptible to counterfeiting, which, notwithstanding the loss of value to the producer, can also pose a health risk to the end consumer through the use of low quality and at time poisonous product substitutes. Therefore, protecting the integrity of the package and thus the brand is important for consumer confidence in a given brand as well the public health. The customer requirements for the spirits closures in markets where counterfeiting is an issue or brand protection of the utmost importance include shelf-evident tamper-resistance features, arrangements which inhibit the removal of the closure from the container finish, and/or features which discourage reuse of the closure components.

While designs commercial in many markets may have at one point minimally met customer requirements, in many cases these design have been in use for decades, which has led to many brand falling victim to small scale or industrial counterfeiting. In addition, these designs may have the undesirable trait of tamper-evidence actuation leading to the possibility of closure pieces being incompletely separated from the closure body, leading to the potential for these tamper-evident vestiges to fall into the consumer's drinking vessel upon pouring.

The problem addressed by the present invention is to achieve similar or improved shelf-evident tamper-resistance, while precluding the possibility of closure pieces falling into the consumer's beverage. Additionally, a focus has been placed on achieving said functionality without compromising the overall closure aesthetic.

SUMMARY OF THE INVENTION

In accordance with the present invention, various embodiments of a tamper-evident closure include arrangements configured to provide the desired tamper-evidence which act in cooperation with a container closure of an associated container. By these arrangements, the tamper-evident closure can be removed to thereby permit access to the container closure and the container contents, while introduction of any loose components of the tamper-evident features into the contents is desirably avoided. In some embodiments, at least a portion of the tamper-evident closure is removed together with the container closure, to thereby provide access to the container contents by a so-called "single opening event."

In one aspect of the invention, a tamper-evident closure comprises an upper, annular top wall portion defining a central opening, and a discontinuous, annular skirt portion depending from the top wall. The annular top wail portion is configured for positioning over a circumferential rim of a container closure. The discontinuous skirt portion defines a window-like finger opening to facilitate gripping of the skirt portion, with the closure including a lower, annular sleeve portion depending from the annular skirt portion. The annular sleeve portion and the skirt portion are distinguished from each other by a circumferential line of weakness, with the top wall defining a fracturable portion extending from the finger opening defined by the skirt portion to the central opening defined by the upper, annular top wall portion.

By this arrangement, gripping and outward manipulation of the skirt portion at the finger opening permits fracture of the fracturable portion and separation and removal of the top wall portion and the skirt portion from the lower, annular sleeve portion at the circumferential line of weakness, to thereby permit access to the container closure of an associated container. The removable top wall portion and skirt portion thus function as a tear-off band to provide the desired tamper-evidence while providing access to the container closure. In the preferred form, the fracturable portion is defined by an opening in the top wall portion that extends generally tangentially of the central opening.

In another aspect of the invention, the container closure of the associated container includes a top wall portion and an annular skirt portion depending therefrom. The arrangement includes an axial retention element for removably maintaining the container closure in sealing cooperation with said container. The axial retention element may comprise an annular retention bead on the container for engagement with the container closure.

In mother aspect, the container closure includes a top wall portion, and an annular skirt portion depending therefrom, and includes a bore sealing element retained in a spout opening of the associated container by a frictional fit for sealingly engaging a bore defined by the container. The bore sealing element depending from an inside surface of the top wall portion may include one of: (1) a plug seal element, (2) a polymeric cork, and (3) an organic cork.

In another aspect the present invention, the container closure includes a top wall portion and an annular skirt portion depending therefrom, and further includes a plurality of circumferentially spaced cam followers on the skirt portion. The cam followers are spaced and configured to respectively engage a plurality of cam ramps on an outer circumferential surface of the associated container.

In another aspect of the invention, a tamper-evident closure comprises a top wall portion, and an annular skirt portion depending downwardly therefrom, with the skirt portion defining a circumferential fracturable region extending between upper and lower portions of the skirt portion. A plurality of circumferentially spaced-apart, wedge-shaped tongues depend downwardly from the skirt portion beneath the fracturable region. The wedge-shaped tongues each include a vertical surface and an inclined surface, wherein the inclined surface is inclined away from a longitudinal axis of said closure assembly.

A lower sleeve portion of the closure is configured to surround a spout of an associated container, and defines a plurality of recesses configured to respectively receive and accept the wedge-shaped tongues. It is contemplated that the lower sleeve portion be fixed against rotation relative to the associated container. For tamper-evidence, the top wall portion and the upper skirt portion are removable from the lower skirt portion by fracture of the fracturable region. The fracturable region includes a staggered interface, including at least one cam, so that rotation of the upper portion skirt portion relative to the lower portion of the skirt portion causes the cam to urge the lower skirt portion and wedge-shaped tongues downwardly. In this embodiment, the tamper-evident closure can be fitted to an associated container having a container closure, with the tamper-evident closure being joined to the container closure, such as by a locking feature, adhesive, fusion, or the like, so that the container closure is removed from the container together with removal of the top wall portion and upper skirt portion after fracture of the fracturable region. This provides a so-called "single opening event" for gaining access to the contents of the container.

In another aspect of the present invention, a tamper-evident closure is embodied as an assembly, including an inner, container closure, and a tamper-evident closure positioned over the container closure. The tamper-evident closure comprises an overcap including a top wall portion, and an annular skirt portion depending from the top wall portion. The tamper-evident closure further includes a lower, annular sleeve portion depending from the annular skirt portion, and a circumferential, tamper-evident tear band positioned between the overcap and the lower, annular sleeve portion. The tear band includes a tear tab having an inner protrusion thereon, with tear band being joined to said lower sleeve portion at a circumferential, fracturable region.

The tear band is further joined to the container closure at circumferentially spaced, radially extending, frangible bridges, with the annular skirt portion of the overcap defining a plurality of slots to separate the skirt portion into sections and to respectively receive the frangible bridges. At least one of the skirt sections defines a recess configured to retain the inner protrusion of the tear tab, with the overcap being positioned over the container closure to at least partially conceal the tear band and limit accessibility to the tear tab. By this arrangement, limited rotation of the overcap relative to the lower sleeve portion and the container closure urges the inner protrusion outwardly so that the tear tab becomes accessible for removal of the tear band by fracture of the frangible bridges. In the preferred form, after initial rotation of the overcap relative to the container closure, the overcap and the container closure are locked together for simultaneous removal of the overcap and the container closure from the associated container, again providing a "single opening event" for access to the container contents.

Another aspect of the invention is embodied in a tamper-evident closure fitted to a container closure, wherein the tamper-evident closure comprises overcap including a top wall portion positioned to overlie a container closure of an associated container, and inner and outer annular skirt portions depending from the top wall portion. The closure further includes an annular sleeve portion depending from the overcap wherein sleeve portion includes a plurality of upper sleeve segments fracturally joined to each other, and positioned between the inner and outer skirt portions of the overcap. By this arrangement, relative movement of the overcap axially of the annular sleeve portion fractures and separates the sleeve segments to enable access to the container closure. In the illustrated embodiment, the top wall portion of the overcap fractures and separates from the inner and outer skirt portions attendant to the relative movement of the overcap axially of said sleeve portion, but the arrangement can be configured such that the top wall portion remains joined to the container closure.

Other features and advantages of the present invention will be readily apparent from the following detailed description, the accompanying drawings, and the appended claims.

BRIEF DESCRIPTION OF THE DRAWINGS

FIG. 11A is an exploded, diagrammatic, isometric view depicting a variation of an embodiment of the present invention;

FIG. 11B is a diagrammatic, side-elevational view further depicting a portion of the embodiment of the present invention shown in FIG. 11A;

FIG. 11C is a diagrammatic, side-elevational view further depicting a portion of the embodiment of the present invention shown in FIG. 11A;

DETAILED DESCRIPTION OF THE PREFERRED EMBODIMENTS

Figure 1:
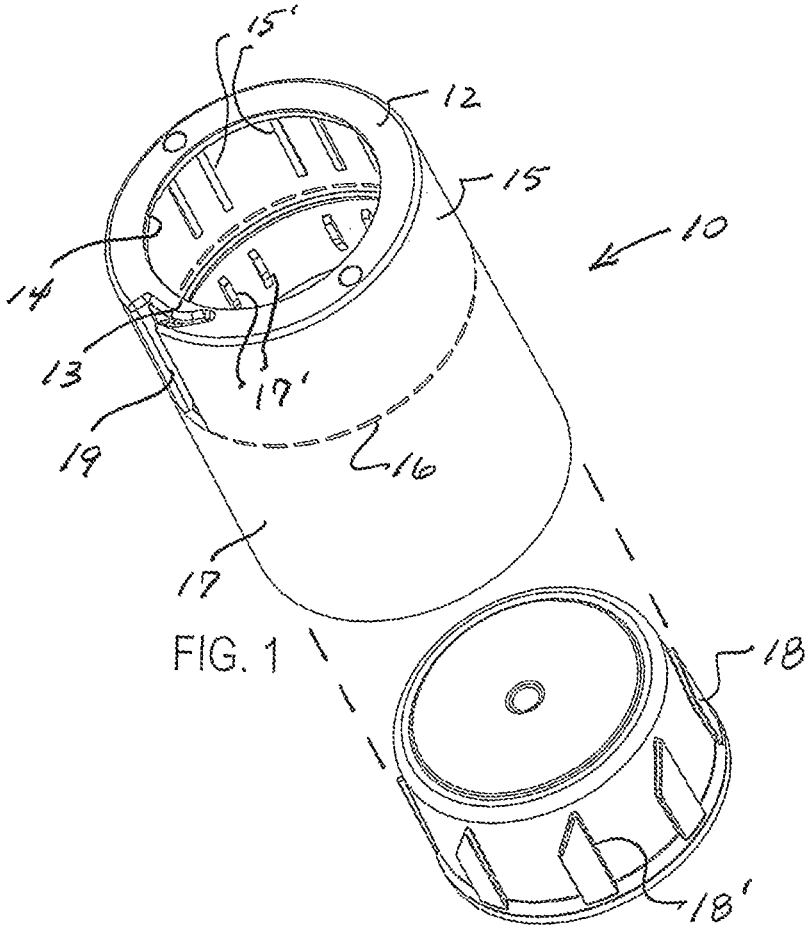
FIG. 1 is an exploded, diagrammatic, isometric view depicting a first embodiment of the present invention, showing a tamper-evident closure configured to provide tamper-evidence for an associated container.
Figure 2:
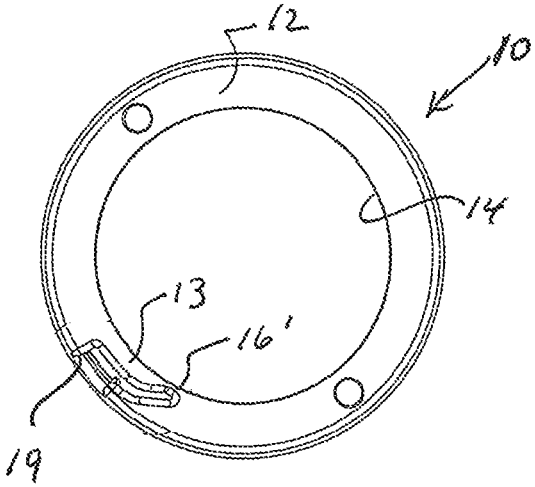
FIG. 2 is a top, plan view of the tamper-evident closure shown in FIG. 1.
Figure 3:
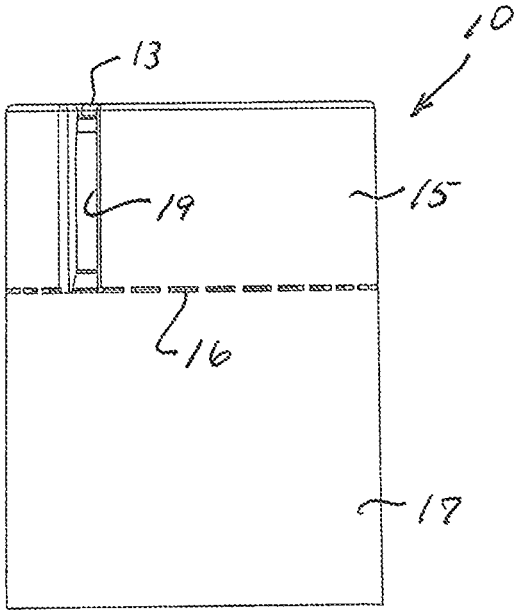
FIG. 3 is a side elevation view of the tamper-evident closure shown in FIGS. 1 and 2.

While the present invention is susceptible to embodiment in various forms, there are shown in the drawings and hereinafter be described various embodiments, with the understanding these embodiments are considered to be exemplary of the invention, and are not intended to limit the invention to the specific embodiments illustrated.

Embodiments of the present invention include tamper-evident designs which meet the required shelf-evident tamper-resistance without the possibility of semi-retained pieces falling into the beverages.

In accordance with the present invention, various embodiments of a tamper-evident closure for use with a container having a container closure sealingly applied thereto. In some embodiments, removal of the tamper-evident closure provides access to the container closure and access to the container contents. In other embodiment, the tamper-evident closure acts in concert with the container closure, so that at least a portion of the tamper-evident closure is removed together with the container closure to provide a so-called "single opening event." Introduction of any loose components of the tamper-evident features into the container contents is desirably avoided.

With reference now to FIGS. 1-5, therein is shown a first embodiment of the present invention, comprising a tamper-evident closure 10. This type of closure is sometimes referred to as a security seal, and can be configured for fitment to an associated container and container closure. The desired shelf-evident tamper-resistance is achieved with a tear-away band configured as a discontinuous skirt portion, with a window-like finger opening providing access to manipulate, fracture, and separate the band.

In a presently preferred embodiment, the tamper-evident closure 10 is molded from high density polyethylene (HDPE), but other suitable polymeric materials can alternatively be employed.

In this embodiment, the tamper-evident closure 10 comprises an upper, annular top wall portion 12 defining a central opening 14, and a discontinuous, annular skirt portion 15 depending from the top wall 12. A lower, annular sleeve portion 17 depends from the annular skirt portion 15. The closure 10 is thus configured for fitment to the neck portion or like feature of the finish of an associated container C. The annular top wall portion is configured for positioning over a circumferential rim of an associated container closure 18.

The discontinuous skirt portion 15 defines a window-like finger opening 19 to facilitate gripping and outward manipulation of the skirt portion 15 and the top wall portion 12. The annular sleeve portion 17 and the skirt portion 15 are distinguished from each other by a circumferential line of weakness 16, such provided as by suitable scoring, circumferentially spaced frangible bridges, or like preferential weakening. The top wall 12 defines a finger-like fracturable portion 13 that extents generally inwardly from the finger opening 19 to the central opening 14, and which terminates at a fracturable region 16'. The opening on the top wall that terminates in the fracturable region 16' extends from the finger opening 19 generally tangentially of the central opening 14, and thus defines the fracturable portion 13.

In the illustrated embodiment, the inside surface of skirt portion 15 is provided with a plurality of circumferentially spaced, axially extending projections 15', which are configured to engage and cooperate with container closure 18 to prevent relative rotation between the skirt portion and the closure 18. To this end, the container closure 18 can be provided with gripping knurls 18' for engagement with the projections 15', with the wedge-like configuration of the knurls 18' desirably acting to align the components with each other during assembly. The inside surface of annular sleeve portion 17 can similarly be provided with a plurality of projections 17' for engagement with the associated container to prevent relative rotation therebetween.

For removal of the tamper-evident closure 10, the skirt portion 15 is gripped and manipulated at the finger opening 19, and pulled generally radially outwardly, with the fracturable portion 13 of the top wall portion fracturing and torn at the fracturable region 16'. The skirt portion 15 and top wall portion 12 can thereafter be removed together from the lower sleeve portion 17 by fracture at the line of weakening 16, with the sleeve portion 17 typically remaining in place on the associated container C.

Figure 4:
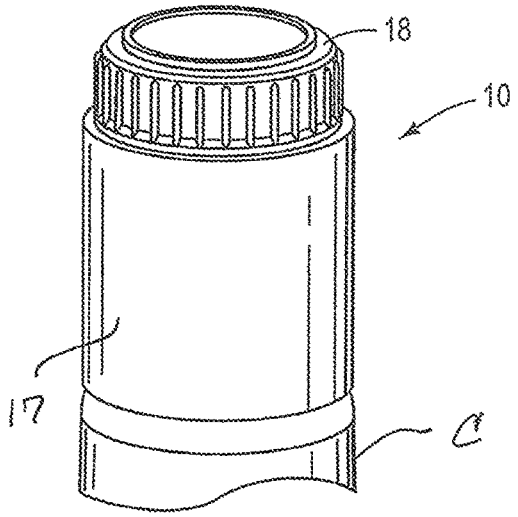
FIG. 4 is a diagrammatic, isometric view depicting the first embodiment of the present invention, including a container closure for an associated container, after removal the tamper-evident closure arrangement shown in FIGS. 1-3, thereby providing access to the container closure.
Figure 5:
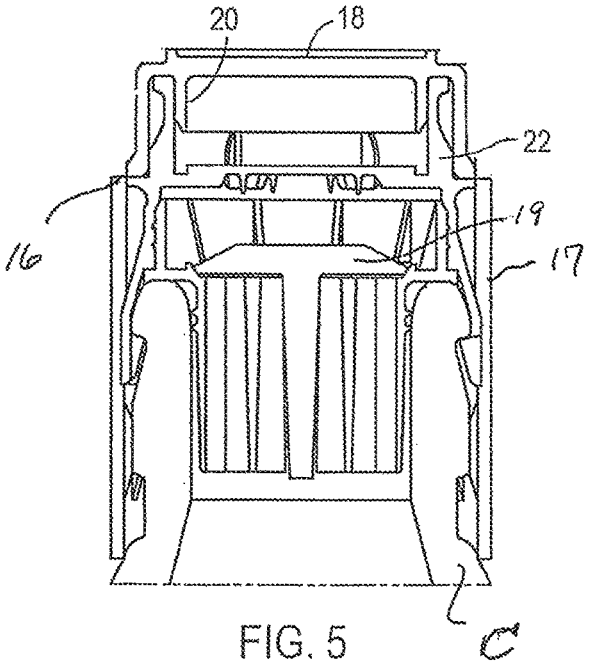
FIG. 5 is a diagrammatic, cross-sectional view of the first embodiment showing a friction fit arrangement for the container closure.

FIG. 4 shows the tamper-evident closure 10 with the top wall portion 12 and skirt portion 15 removed to reveal the now accessible container closure 18 in the form of a reclosable cap, such as a twist-off stopper. Notably, economical manufacture of this embodiment is promoted in that the geometry of the finger opening 19 and fracturable portion 13 of the tear-off portion of the closure can be formed with axial-open and strip molds, as opposed to side-action molds, thus reducing tooling costs, and ultimately the cost of the product. Once removed, the band-like element is discarded in its entirety, with no vestiges capable of making their way into a consumer's vessel.

In this embodiment, the tamper-evident closure 10 is shown with a container fitted with an anti-refill closure assembly, including a one-way valve member 19, which desirably inhibits introduction of adulterated or counterfeit product, such as an adulterated spirits product, into the container. However, it to be understood that any of the embodiments of the present invention can be employed with closures or container pouring fitments other than the illustrated anti-refill arrangement.

The container closure 18 and the associated container may include an axial retention element for removably maintaining the container closure in sealing cooperation with the container. The axial retention element may comprise an annular retention bead 25 on the container for engagement with the container closure (see FIG. 7). The container closure may be configured to include a sealing element retained in the spout opening of the associated container by a frictional fit for sealingly engaging a bore defined by the container. Such a bore sealing element depends from an inside surface of said top wall portion of the container closure 18, and may include one of: (1) a plug seal element 20, (2) a polymeric cork 28 (FIG. 8), and (3) an organic cork.

Figure 6:
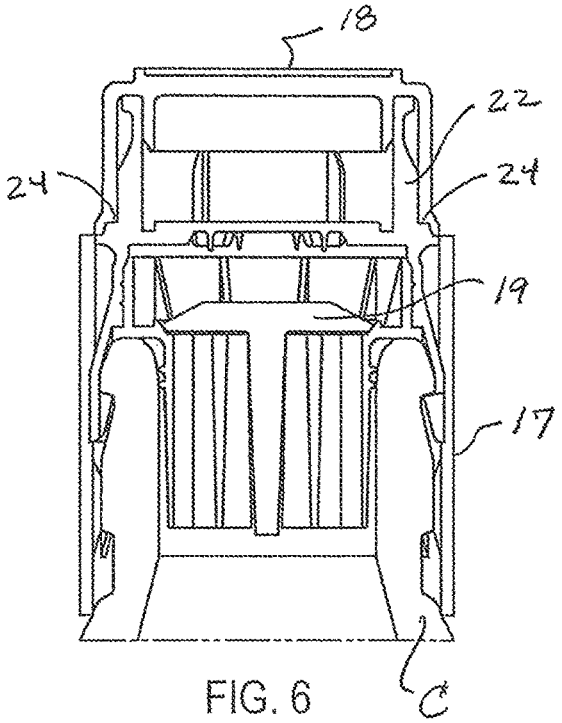
FIG. 6 is a view similar to FIG. 5 depicting an alternative configuration of the container closure.
Figure 7:
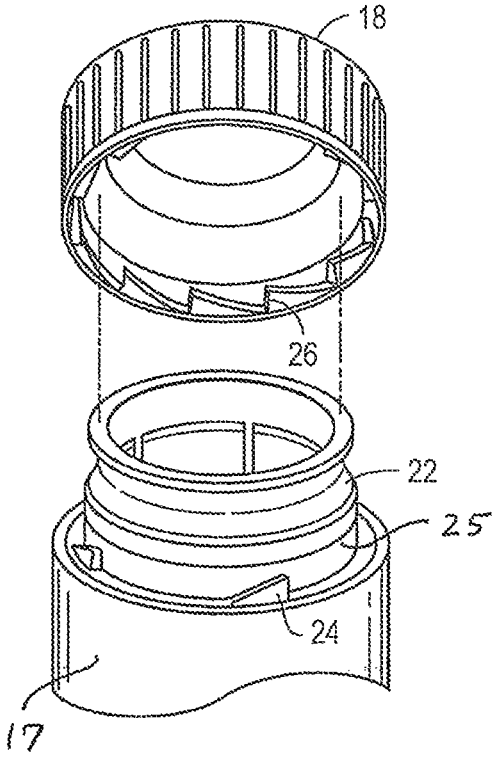
FIG. 7 is diagrammatic, isometric exploded view further showing the container closure of FIG. 4, and the arrangement of the associated container for cooperation therewith.
Figure 8:
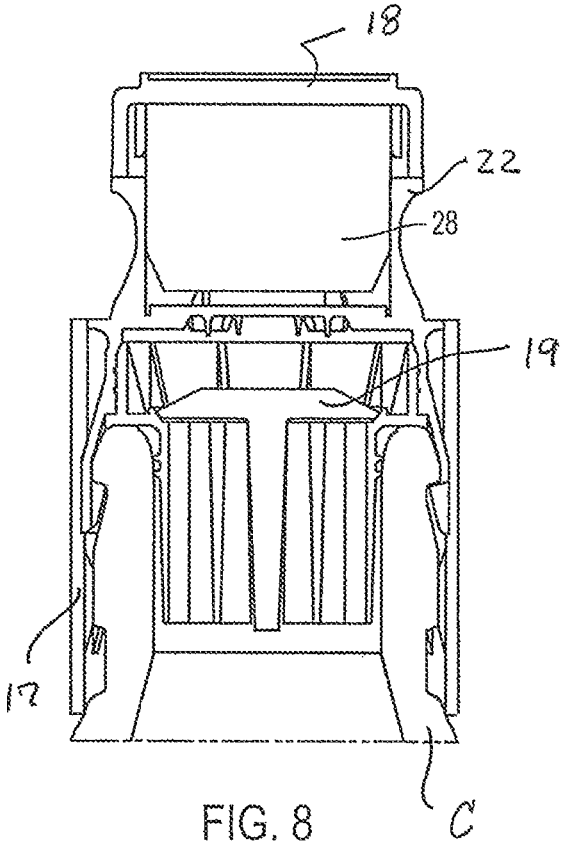
FIG. 8 is a diagrammatic, cross-sectional view similar to FIG. 5 showing a further alternative embodiment of the container closure.

FIGS. 6 and 7 show an alternative arrangement for the container closure of the assembly, including a closing/opening mechanism comprising a cam and the retention bead 25 for opening and retention, respectively. At least one cam ramp 24 on the outer circumferential surface of the container, such as on pouring fitment 22, interacts with a respective one of the plurality of cam followers 26 on the underside of the skirt of the primary closure 18 to provide a mechanical advantage to urge the closure upwardly to overcome annular retention bead 25 on fitment 22. In the illustrated embodiment, a plurality of circumferentially spaced cam followers 26 are shown, with the cam followers spaced and configured to respectively engage a plurality of cam ramps 24. This allows for a simple pop-on/twist-off package interaction that requires no pre-orientation.

As will be appreciated, sealing features such as disclosed above, as well as the one or more cam ramps and followers 24, 26, and/or an axial retention element such as annular retention bead 25, can be included in the following embodiments of the invention, as may be desired.

Figure 9:
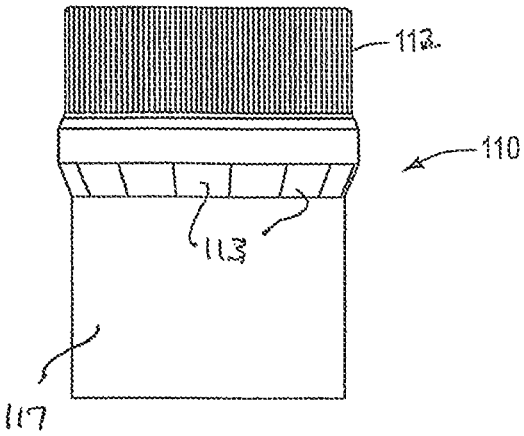
FIG. 9 is a diagrammatic, side-elevational view depicting another embodiment of the tamper-evident closure of the present invention.
Figure 11:
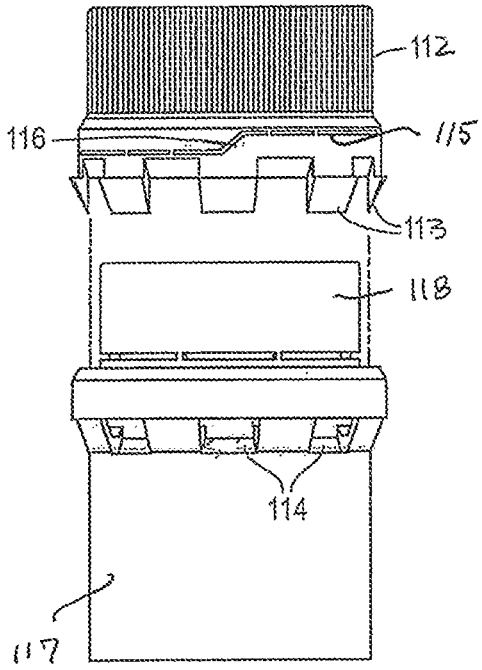
FIG. 11 is an exploded, diagrammatic, side-elevational view further depicting the embodiment of the present invention depicted in FIG. 9.
Figure 10:
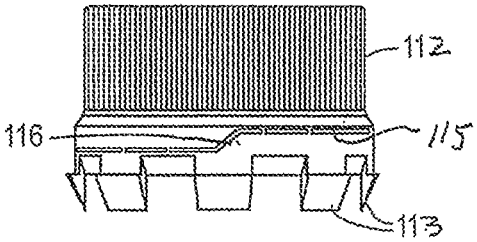
FIG. 10 is a diagrammatic, side-elevational view depicting a portion of the embodiment of the present invention depicted in FIG. 9.
Figure 12:
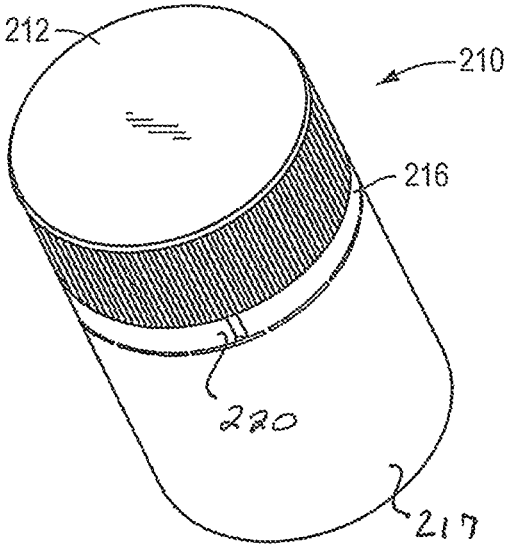
FIG. 12 is a diagrammatic, isometric view depicting another embodiment of the present invention.
Figure 13:
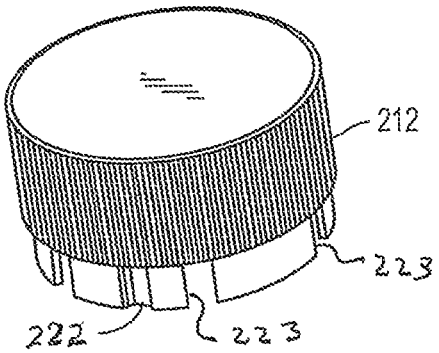
FIG. 13 is a diagrammatic, isometric view further illustrating the embodiment of FIG. 12.
Figure 14:
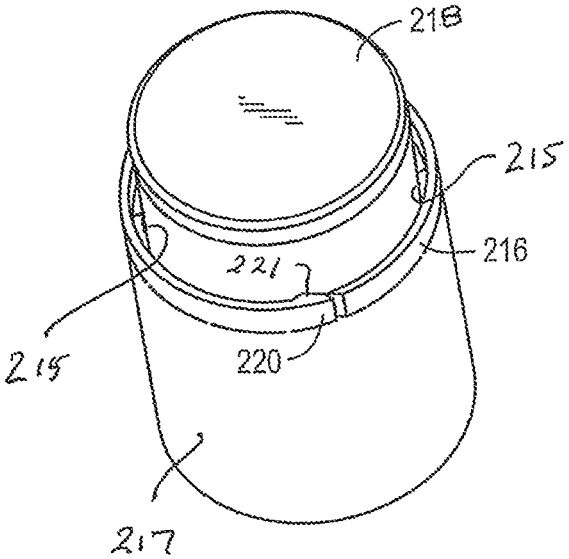
FIG. 14 is a diagrammatic, isometric view further illustrating the embodiment of FIG. 12.
Figure 15:
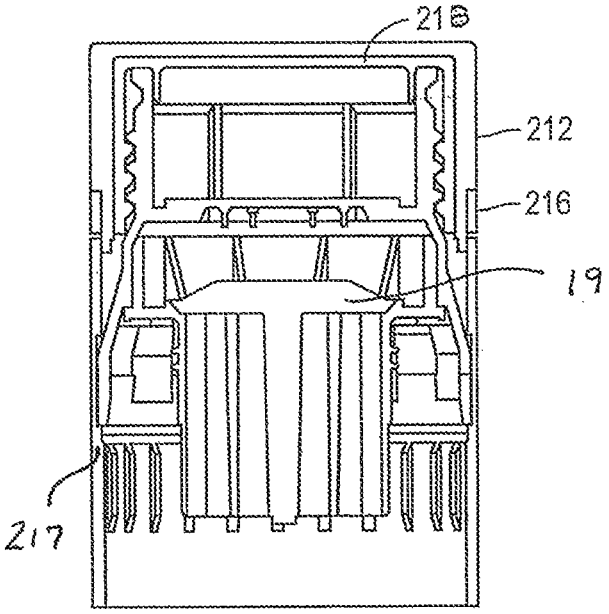
FIG. 15 is a diagrammatic, cross-sectional view of the embodiment shown in FIGS. 12-14.
Figure 16:
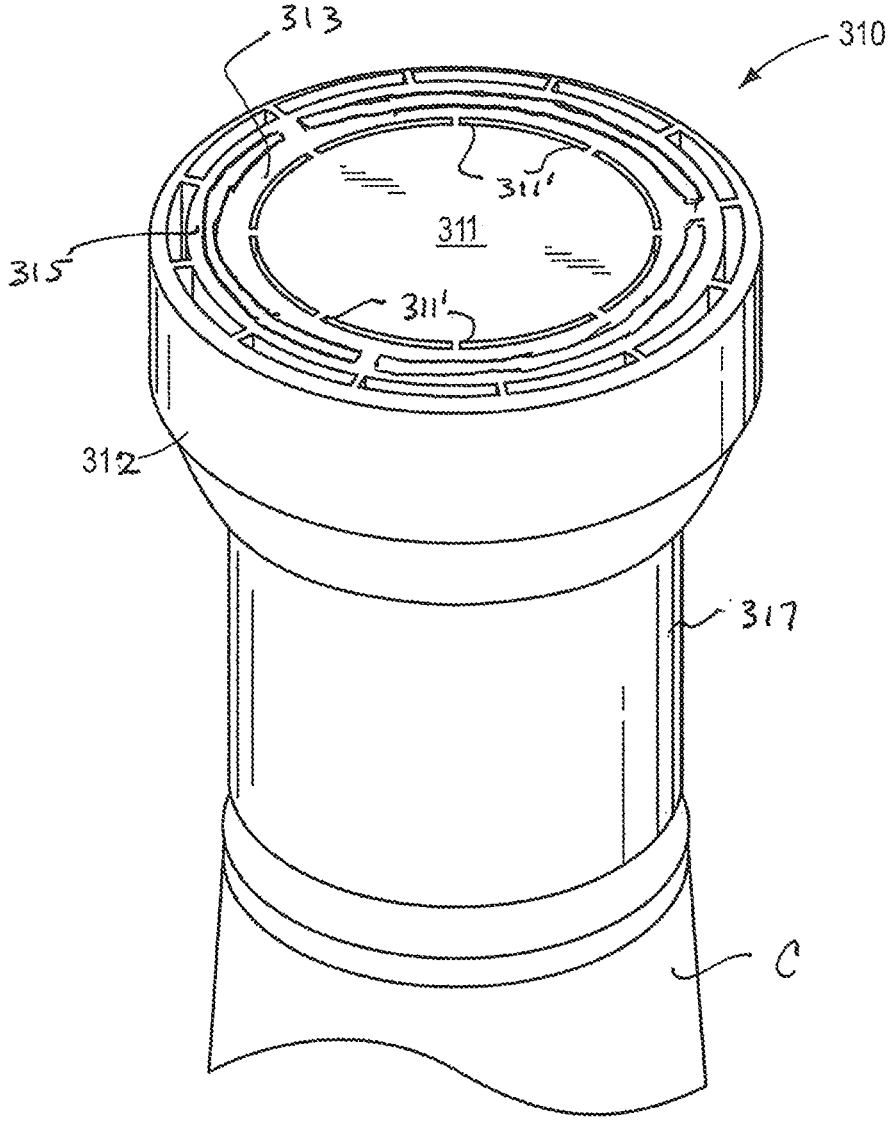
FIG. 16 is a diagrammatic, isometric view depicting another embodiment of the present invention.

A further embodiment of the present closure assembly 110 is shown in FIGS. 9-11, and includes a tamper-evident closure having an upper portion or overcap 112, and which includes an arrangement of nesting tongues 113, and recesses 114 in the lower sleeve portion 117 of the closure. This arrangement provides the desired tamper-evident access to the inner, container closure 118, and may be configured such that the overcap 112 and container closure 118 are removed together to provide a "single opening event."

As shown, in this embodiment, the overcap 112 includes a top wall portion, and an annular skirt portion depending downwardly therefrom. A plurality of circumferentially spaced apart, wedge-shaped tongues 113 depend downwardly from the skirt, with the wedge-shaped tongues 113 each comprising a vertical surface and an inclined surface, wherein the inclined surface is inclined upwardly and away from a longitudinal axis of the closure.

The lower sleeve portion 117 of the closure is provided in the form of a sleeve configured to surround a container spout. The sleeve comprises a plurality of the recesses 114 to respectively receive and accept the wedge-shaped tongues 113 during fitment of the tamper-evident closure 110 to a container to which the container closure 118 has already been applied. In this embodiment each of the tongues 113 defines an upper, locking surface which cooperates with a respective one of the recesses 114 to lock the tongue in the recess.

A fracturable region of the tamper-evident closure 110 is provided at a preferentially weakened line of weakness 115 in the overcap 112, which separates and distinguishes a lower portion of the skirt from an upper portion of the skirt portion. The wedge-shaped tongues are thus provided on the lower skirt portion for respective disposition in the recesses 114 defined by the lower sleeve portion 117. Suitable frangible leaders or bridges, such as defined between cuts, scores, or molded gaps, provide the desired fracturable connection at the line of weakness 115. The line of weakness comprises a staggered interface, and defines at least one cam 116, as shown. By this arrangement, rotation of the upper portion of the overcap 112, relative to the lower skirt portion and the lower sleeve portion 117 fractures the line of weakness, and causes the cam 116 to urge the lower skirt portion and the wedge-shape tongues downwardly. It is contemplated that function in this fashion is best achieved by fixing the lower sleeve portion 117 against rotation on the associated container.

Thus, when the upper portion of the overcap 112 is removed and the frangible leaders or bridges are broken, cam 116 on the overcap 112 forces the lower skirt portion and wedge-shaped tongues 113 downwardly, which in this embodiment creates a readily visually discernable staggered interface. This staggered interface thus is the shelf-evident tamper-resistance. Desirably, the tamper band is secured in the sleeve geometry, with tongues 113 retained in recesses 114, thus eliminating any parts which can fall off.

This version of the present invention can be configured such that the crenellations in the sleeve portion 117, which receive the wedge-shaped tongues 113, are "webbed over," or covered. By virtue of a point of weakness in the web, and corresponding high contact pressure geometry on the wedge-shaped tongues, the web is pierced by the tamper-evidence actuation, leading to retained, irreversible tamper-evidence.

FIGS. 11A-11B illustrate this variation of this embodiment of the present invention, including the provision of pierceable webs 114'. Each such pierceable web is positioned in the lower sleeve portion 117 at the bottom of a respective one of the recesses 114. The webs 114' are pierced by the respective ones of the wedge-shaped tongues 113 received in each recess attendant to rotation of the upper skirt portion relative to the lower portion of the skirt portion, with the action of cam 116 thereby urging the lower skirt portion downwardly. As illustrated in FIG. 11C, each of the tongues 113 can be provided with a respective piercing element 113' for effecting piercing of the respective web 114'.

In this embodiment, the overcap 112 and the associated container closure 118 are configured to be secured to each to each other, including the provision of circumferentially extending ribs 119 for axially joining the overcap and closure, and the provision of gripping knurls 119' for fixing the closure against rotation relative to the overcap. It will also be noted that in this embodiment, the container closure 118 is fracturably joined to the sleeve portion 117 at a preferentially weakened circumferential line of weakening 118'.

One of the desirable aspects of this embodiment of the present invention, as shown in FIGS. 9-11, and in FIGS. 11A-11C, is the manner in which the upper and lower components of the construction, including tongues 113 and recesses 114 defined by the sleeve portion 117, smoothly blend together, thereby enhancing the aesthetic appeal of the arrangement.

Yet another embodiment of a tamper-evident closure is shown in the form of a closure 210, as shown in FIGS. 12-15. This embodiment includes an inner, container closure 218 having a circumferential tamper evident tear ring or band 216, having a tear or pull tab 220. The tear band is joined to a lower sleeve portion 217 of the tamper-evident closure at a fracturable region, with the tear band in turn connected to the inner container closure 218 by a plurality of circumferentially spaced, generally radially extending frangible bridges 215 (the container closure 218 and lower sleeve 217 are molded together).

An outer closure or overcap 212 of the tamper-evident closure is fitted over and locks on to the container closure 218, and is preferably assembled onto the container closure 218 and the sleeve portion 217 so the arrangement can be fitted as an assembly to the associated, filled container. The overcap 212 includes a top wall portion and an annular skirt portion depending from the top wall portion. The overcap 212 is positioned over the container closure 218 to at least partially conceal and limit accessibility to the tear tab, with the tear band 216 thus positioned between the overcap 212 and the lower sleeve portion 217 of the outer, secondary closure.

The overcap 212 of the tamper-evident closure 210 is configured for limited rotation relative the container closure 218, and relative to the lower sleeve portion. The overcap 212 includes a plurality of gaps or slots 223 to separate the skirt portion thereof into sections, with the resultant gaps or slots respectively receiving the radially extending frangible bridges 215 between the container closure 218 and the tear band 216 of the closure.

At least one inner protrusion 221 is provided on the inner diameter of the tear band 216 at the pull tab 220. A corresponding recess 222 for the protrusion 221 is provided in one of the skirt sections of the rotatable overcap 212, such that it retains the protrusion feature axially, but allows for relative rotation between the overcap 212 and the container closure 218 and sleeve portion 217. A slight relative rotation urges the protrusion 221 outwardly, which in turn causes the pull tab 220 to protrude from the cylindrical envelope of the closure sleeve portion, making the tab accessible. At the end of the travel in which the tab has been flared out to its maximum extent, the overcap 212 and container closure 218 lock together. The consumer removes the circumferential tamper-evident tear band 216 (which fractures bridges 215), and proceeds to open the package without further inhibiting features. Again, a "single opening event" is achieved by removal of the overcap 212 and the container closure 218 together.

Thus, this embodiment functions such that rotation of the overcap 212 exposes a previously difficult to access pull tab 220 for a tear-off band 216. The split skirt and cam geometry is fitted to the sleeve/stopper with discrete connections between the sleeve portion and the stopper, i.e., the container closure (which are molded together).

Yet one more embodiment of a tamper-evident closure 310 shown is in FIGS. 16-19, and functions to provide the desired tamper-evidence attendant to axial movement of an overcap of the arrangement relative to the associated sleeve portion. A unique, "champagne-like" opening action is thus achieved.

In this embodiment, closure 310 includes an overcap 312 having a top wall portion 311, and inner and outer annular skirt portions 313, 315, depending from the top wall portion. The top wall portion 311 overlies an inner, container closure 318, and may be joined to the container closure such as by the provision of suitable adhesive, fusion bonding, mechanical features, or the like. In the illustrated embodiment, the top wall portion 311 is fracturable attendant to opening, and to this end is fracturably joined to the inner and outer skirt portions at frangible connections 311'.

Figure 17:
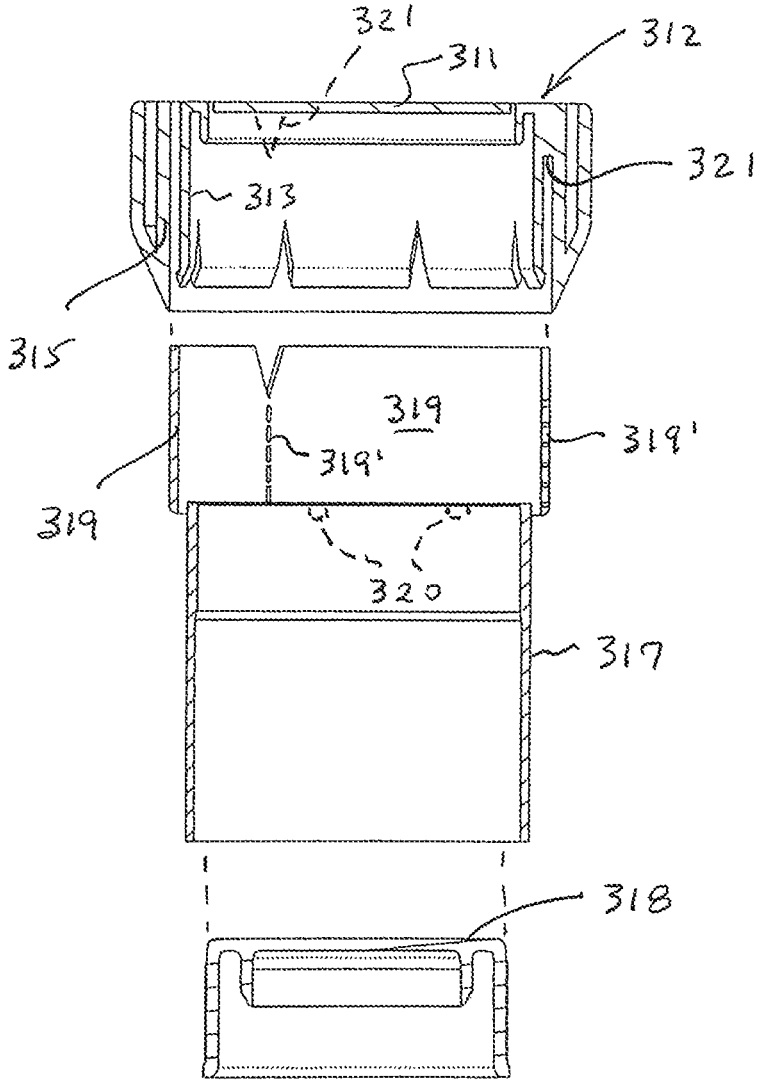
FIG. 17 is an exploded, diagrammatic, cross-sectional view depicting the embodiment of the present invention shown in FIG. 16.
Figure 18:
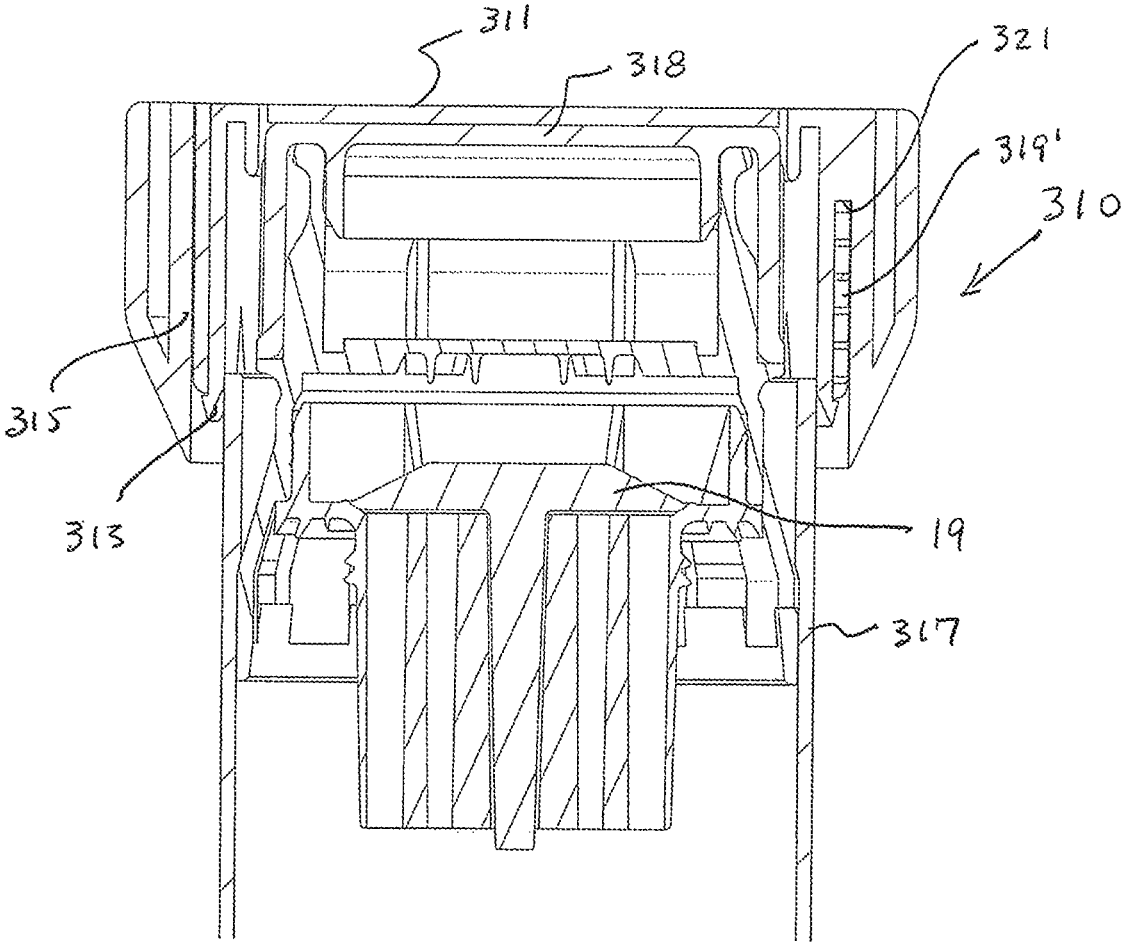
FIG. 18 is a diagrammatic, cross-sectional view depicting the embodiment of the present invention shown in FIG. 16.
Figure 19:
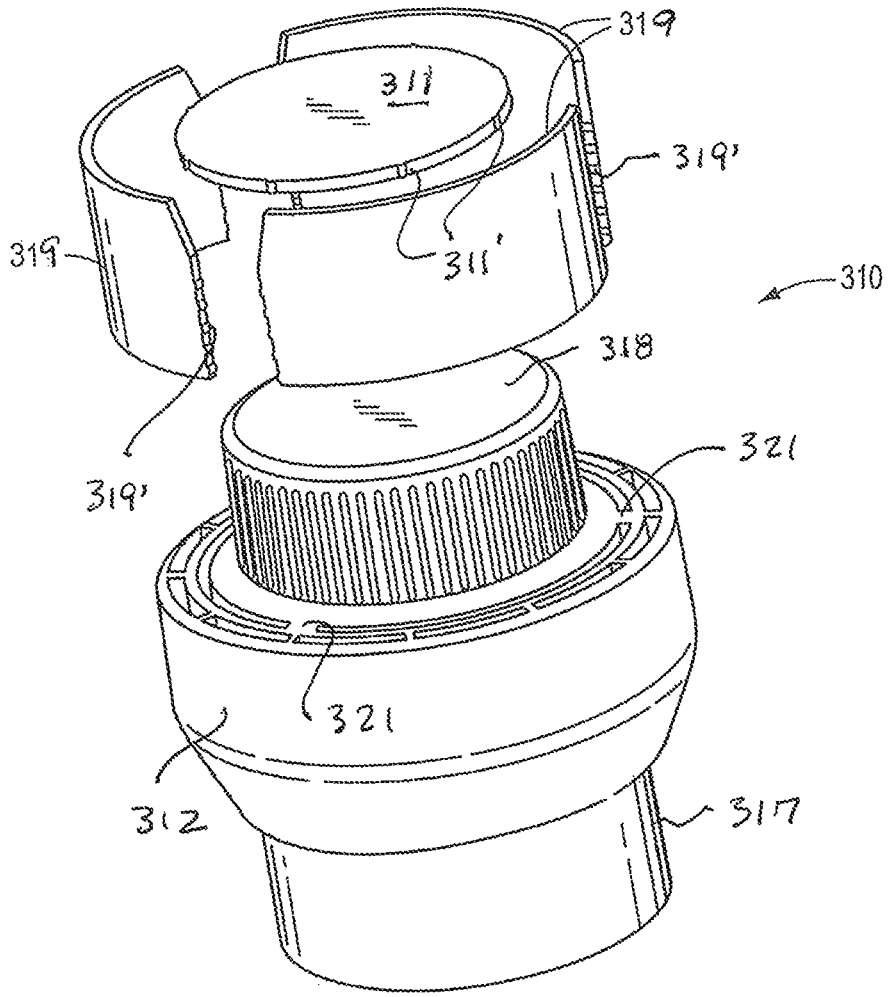
FIG. 19 is a diagrammatic, isometric view depicting the embodiment of the present invention shown in FIG. 16 during removal from an associated container.

The tamper-evident closure 310 further includes an annular sleeve portion 317 depending from the overcap 312. Notably, the sleeve portion 317 includes a plurality of upper sleeve segments 319 which are fracturably joined to each other at frangible connections 319'. The sleeve segments are further fracturably joined to the lower portion of the sleeve portion 317 at frangible ribs 320 (FIG. 17).

Tamper-evident actuation of this embodiment is effected by urging the overcap 312 downwardly of the sleeve portion 317, which relative axial movement acts to drive the sleeve segments 319 upwardly between the inner and outer skirt portions 313, 315. A plurality of wedge-like splitting elements 321 provided on the overcap 312 engage the sleeve segments at the respective fractuable connections 319', separating and fracturing the segments, and fracturing frangible ribs 320. As noted, in the illustrated embodiment, attendant to this relative axial movement, the top wall portion 311 of the overcap 312 is fractured and separated by fracture of frangible connections 311', thereby providing the desired access to container closure 318. This embodiment improves upon the current art in the increased difficulty of both reproduction and reuse.

There are several advantages of the different embodiments. By way of example, and by no means exclusive, some embodiments, such as FIGS. 1-8, allow the consumer to remove the tamper-evident piece and discard it prior to using the package. This action eliminates the potential of a piece of the tamper band "hanging up on" or otherwise remaining connected to other components of tamper-evident closure, and undesirably falling off during the pouring step. In a further embodiment, for example FIGS. 9-11 and FIGS. 11A-11C, there are no break-away pieces, and the closure can be difficult to reassemble and thus resell, and has a unique aesthetic. Similarly, in the embodiment of FIGS. 12-15, there are no break-away tamper-evident components. In an alternative embodiment, for example FIGS. 16-19 pieces are allowed to break away, but the improvement lies in the increased difficulty to the counterfeiter of reassembling the multiple connection points. It also has a unique opening mechanism and aesthetic.

From the foregoing, it will observed that numerous modifications and variations can be effected without departing from the true spirit and scope of the novel concept of the present invention. No limitation with respect to the specific embodiments disclosed herein is intended or should be inferred. The disclosure is intended to cover, by the appended claims, all such modification as fall within the scope of the claims.

What is claimed is:

1. A tamper-evident closure, comprising:

an upper, annular top wall portion defining a central opening, and a discontinuous, annular skirt portion depending from said top wall portion, said top wall portion extending inwardly from said annular skirt portion, said skirt portion defining a finger opening to facilitate gripping of said skirt portion, and a lower, annular sleeve portion depending from said annular skirt portion, wherein said annular sleeve portion and said skirt portion being distinguished from each other by a circumferential line of weakness, said top wall portion defining a fracturable portion that extends across said top wall portion, the fracturable portion extending from said finger opening defined by said skirt portion to said central opening defined by said upper, annular top wall portion and terminating at a fracturable region such that gripping of said skirt portion at said finger opening permits fracture of said fracturable region, and separation and removal of said top wall portion and said skirt portion from said lower, annular sleeve portion at said circumferential line of weakness to thereby permit access to a container closure of an associated container, wherein said annular skirt portion defines a plurality of axially extending projections on an inside surface of said skirt portion for engagement with said container closure to prevent relative rotation therebetween.

2. A tamper-evident closure in accordance with claim 1, wherein an opening on the top wall portion terminates in the fracturable region and extends from the finger opening generally tangentially of the central opening.

3. A tamper-evident closure, comprising:

an upper, annular top wall portion defining a central opening, and a discontinuous, annular skirt portion depending from said top wall portion, said top wall portion extending inwardly from said annular skirt portion, said skirt portion defining a finger opening to facilitate gripping of said skirt portion, and a lower, annular sleeve portion depending from said annular skirt portion, wherein said annular sleeve portion and said skirt portion being distinguished from each other by a circumferential line of weakness, said top wall portion defining a fracturable portion that extends across said top wall portion, the fracturable portion extending from said finger opening defined by said skirt portion to said central opening defined by said upper, annular top wall portion and terminating at a fracturable region such that gripping of said skirt portion at said finger opening permits fracture of said fracturable region, and separation and removal of said top wall portion and said skirt portion from said lower, annular sleeve portion at said circumferential line of weakness to thereby permit access to a container closure of an associated container, wherein said annular sleeve portion defines a plurality of projections on an inside surface thereof for engagement with said associated container to prevent relative rotation therebetween.

4. A container assembly, comprising a container including a container closure, the container closure including a top wall portion, and an annular skirt portion depending therefrom, a tamper-evident closure including:

an upper, annular top wall portion defining a central opening, and a discontinuous, annular skirt portion depending from the top wall portion, said top wall portion extending inwardly from said annular skirt portion, the skirt portion defining a finger opening to facilitate gripping of the skirt portion, and a lower, annular sleeve portion depending from the annular skirt portion, wherein the annular sleeve portion and the skirt portion being distinguished from each other by a circumferential line of weakness, the top wall portion defining a fracturable portion that extends across said top wall portion, the fracturable portion extending from the finger opening defined by the skirt portion to the central opening defined by the upper, annular top wall portion and terminating at a fracturable region such that gripping of the skirt portion at the finger opening permits fracture of the fracturable region and separation and removal of the top wall portion and the skirt portion from the lower, annular sleeve portion at the circumferential line of weakness to thereby permit access to the container closure of the container, wherein the annular skirt portion of the tamper-evident closure defines a plurality of axially extending projections on an inside surface of the skirt portion for engagement with the container closure to prevent relative rotation therebetween.

5. The container assembly in accordance with claim 4, wherein after separation and removal of the top wall portion and the skirt portion of the tamper-evident closure from the lower, annular sleeve portion of the tamper-evident closure, the container closure is adapted to be removed from the container to gain access to the remainder of the container.

6. The container assembly in accordance with claim 4, wherein an opening on the top wall portion of the tamper-evident closure terminates in the fracturable region and extends from the finger opening generally tangentially of the central opening.

7. The container assembly in accordance with claim 4, wherein the annular sleeve portion defines a plurality of projections on an inside surface thereof for engagement with the container to prevent relative rotation therebetween.

8. The container assembly in accordance with claim 4 further including an axial retention element for removably maintaining the container closure in sealing cooperation with the container.

9. The container assembly in accordance with claim 8, wherein the axial retention element comprises an annular retention bead on the container for engagement with the container closure.

10. The container assembly in accordance with claim 4, wherein the container closure further includes a bore sealing element retained in a spout opening of the associated container by a frictional fit for sealingly engaging a bore defined by the container, the bore sealing element depending from an inside surface of the top wall portion and selected from the group consisting of: a plug seal element, a polymeric cork, and an organic cork.

11. The container assembly in accordance with claim 4, wherein the container closure further includes a plurality of circumferentially spaced cam followers on the skirt portion, the cam followers being spaced and configured to engage a plurality of cam ramps on an outer circumferential surface of the container.

12. The container assembly in accordance with claim 4, wherein the removable container closure is in the form of a twist-off stopper.

* * * * *